US005395097A

United States Patent [19]

Dabney et al.

[11] Patent Number: 5,395,097

[45] Date of Patent: Mar. 7, 1995

[54] SPRING WIRE CORE MADE OF NESTABLY STACKABLE HALF UNITS

[75] Inventors: Upton R. Dabney; William C. Rodgers, both of Lexington, Ky.

[73] Assignee: Hoover Group, Inc., Alpharetta, Ga.

[21] Appl. No.: 43,004

[22] Filed: Apr. 5, 1993

[51] Int. Cl.[6] ..... F16F 3/02; A47C 7/35

[52] U.S. Cl. ..... 267/103; 267/80; 5/267

[58] Field of Search ..... 5/247, 255, 267; 267/80, 101, 103, 107, 109

[56] References Cited

U.S. PATENT DOCUMENTS 4,726,572 2/1986 Flesher et al. ..... 267/103 X
4,739,977 4/1988 Dabney ..... 267/103
5,052,064 10/1991 Hagemeister et al. ..... 5/255 X
5,176,397 1/1993 Rodgers et al. ..... 267/103
5,178,367 1/1993 Rodgers et al. ..... 267/103
5,246,210 9/1993 Dabney et al. ..... 267/103

*Primary Examiner*—Robert J. Oberleitner
*Assistant Examiner*—Alfred Muratori
*Attorney, Agent, or Firm*—Harness, Dickey & Pierce

[57] ABSTRACT

A spring wire core for use in bedding mattresses and/or upholstered furniture cushions and the like comprised of a pair of half units. Each half unit includes a surface portion and a plurality of springs projecting in one direction from the surface portion. Connecting elements are provided to enable a pair of half units, one inverted relative to the other, to be connected together forming a wire core with two spaced surface portions. Preferably, the spring portions are configured to enable a plurality of the half units to be nestably stacked one upon another to enable efficient shipping of the half units without compression of the spring portions.

23 Claims, 3 Drawing Sheets

SPRING WIRE CORE MADE OF NESTABLY STACKABLE HALF UNITS

BACKGROUND AND SUMMARY OF THE INVENTION

The present invention relates to spring wire cores for use in furniture items such as mattresses and seat cushions and in particular to a spring wire core assembled from a pair of nestably stackable half units.

Spring wire cores for use in mattresses, seat cushions and the like, are usually comprised of coil springs, continuous or individual, aligned in rows that form a generally rectangular shape. Lacing wires on the top and bottom surfaces of the coil springs hold the coil springs in place, providing a yieldable wire core. The wire cores are typically shipped from the wire manufacturer to upholstery plants for finish manufacturing of the furniture items.

The most common method of bulk packaging of the coil spring wire cores is baling. One bale typically includes 15 to 20 cores fully compressed. Crating material on the top and bottom sides of a bale provides the rigid surface structure necessary to contain the cores. Heavy wire ties are used throughout the edges, ends and center to keep the cores from decompressing to their free state. The baling process is reversed at the upholstery plants. Heavy equipment is required in both locations in order to control the very large loads involved in both baling and unbaling. The process is slow, expensive and sometimes dangerous.

Accordingly, it is an object of the present invention to provide a wire core assembly that can be easily baled and transported without the necessity of compressing the core springs while at the same time reducing the space that is required to ship the wire cores in a relaxed state.

The spring wire cores of the present invention are comprised of two half units. The two half units are assembled together by inverting one unit relative to the other, aligning the two half units and locking then together to form a double sided mattress or seat core. The core is then upholstered in a normal fashion. The half units can be configured to be locked together with or without the use of tools. The half units are preferably configured to permit nestable stacking of the half units. As a result, a plurality of half units can be stacked in a bale, significantly reducing the space needed for shipping a bale without compressing the springs.

Further objects, features and advantages of the invention will become apparent from a consideration of the following description and the appended claims when taken in connection with the accompanying drawings.

DETAILED DESCRIPTION OF THE INVENTION

Figure 1:
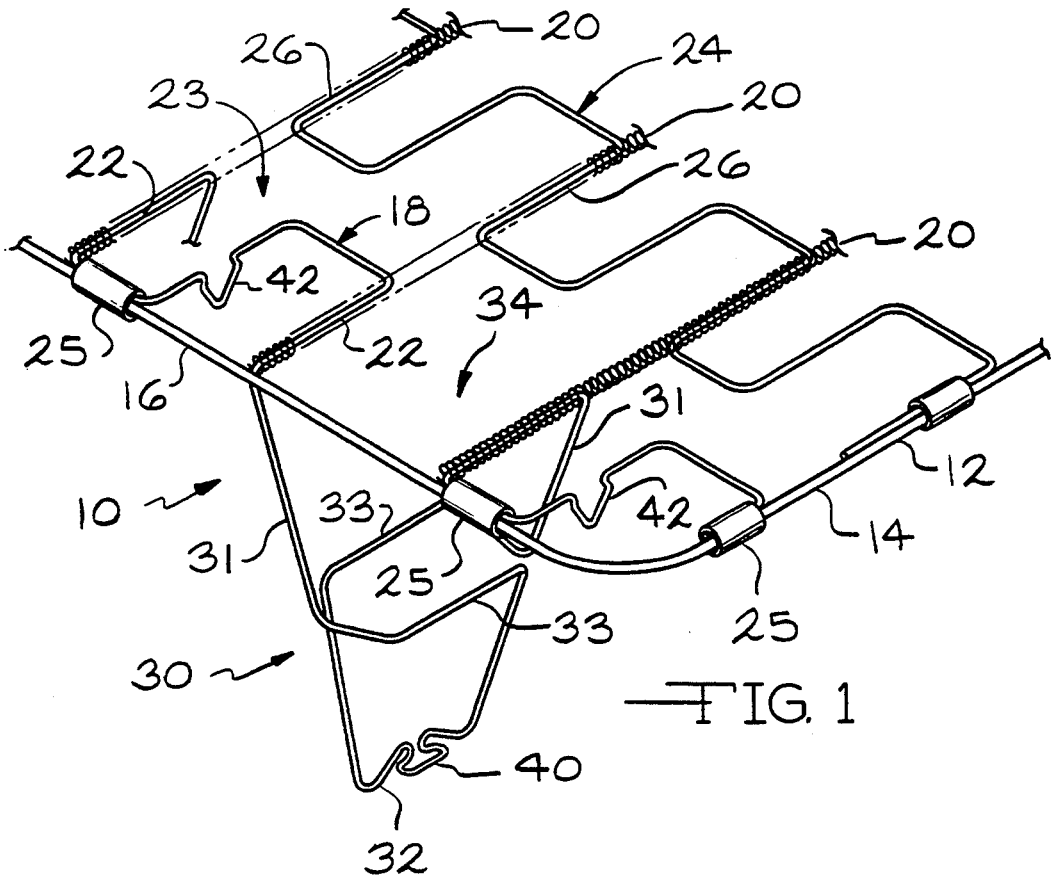
FIG. 1 is a partial perspective view of a spring wire core half unit of the present invention.

A half unit of the spring wire core of the present invention is shown in FIG. 1 and generally designated as 10. Half unit 10 includes a generally rectangular border wire 12 having opposite ends 14 and opposite sides 16. Only one of the ends and sides are shown in FIG. 1. A plurality of continuous spring elements 18 extend from end-to-end of the border wire 12. The continuous spring elements 18 are coupled to one another by a plurality of helical lacing wires 20 which extend from side-to-side of the border wire. The lacing wires 20 are wrapped around spaced parallel mounting bars 22 of the top portions 23 of the continuous spring elements 18. The spring elements are attached to the border wire by clips 25 in a conventional manner. In the preferred arrangement, the continuous spring elements extend from end-to-end while the lacing wire extend from side-to-side. It will be appreciated that other orientations can be employed if desired.

Surface filler wires 24 extend from end-to-end of the border wire between the continuous spring elements 18. The surface filler wires provide support for upholstery pads between the spring elements. In the embodiment shown, the filler wire is a square wave shape. The particular shape is not important for the function of the filler wire. A curved design would perform just as well. The only shape requirement of the filler wire 24 is that certain mounting bars 26 designated for clipping or lacing be in line with the corresponding mounting bars 22 of the spring elements.

The top portions 23 of the spring elements 18, the lacing wires 20 and the filler wires 24 form a surface portion 28 of the half unit 10. The surface portion 28 can be generally characterized as planar. However, in certain situations, the surface portion may be crowned or otherwise deviate from a true plane. The term "planar" as used in the specification and claims is intended to include these deviations from a true plane.

The spring elements 18 include spring portions 30 which project from the spring element top portions 23 and from the surface portion 28 in a common direction, downward, as shown in FIG. 1. The spring portions 30 are generally V-shaped and taper downward to an vertex 32 at the base of the spring portions. The spring portions 30 are of a torsion bar type with the spring portions each having a pair of legs 31. The legs each have a torsion bar 33 between the top portion of the spring element and the vertex 32 of each spring portion. The open top design of the V-shaped spring portions allows the torsion bars 33 in each spring leg to actuate independently from the other. This enhances the ability of the spring wire core to conform to human scale loading more so than a core made of coil springs. The wire core of the present invention is constructed to avoid wire contact except where assembly is necessary between the spring elements and the lacing wires on the surface portions. All springs have room to fully actuate without interference from adjoining springs and therefore noise through internal wire contact as in continuous coil units, is eliminated.

Figure 2:
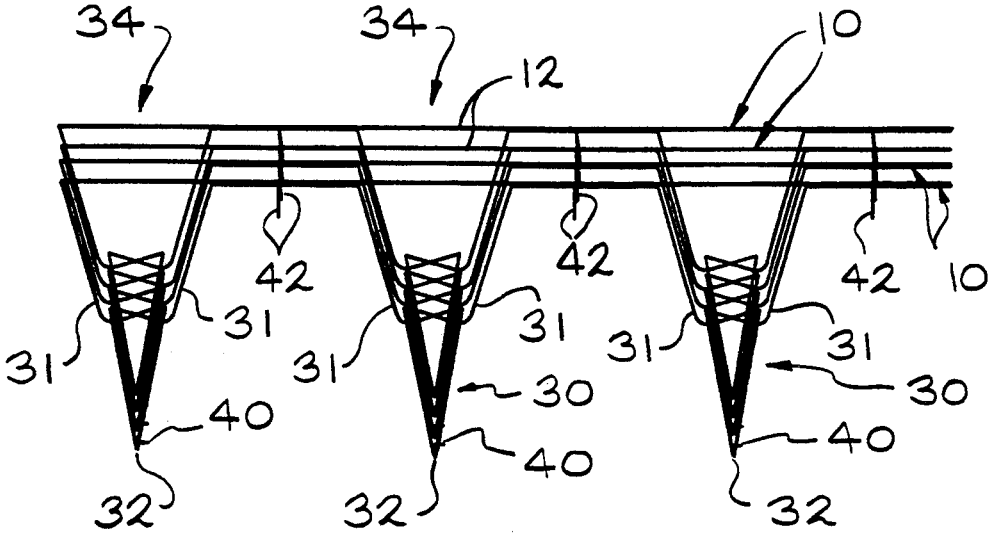
FIG. 2 is a single line schematic elevational view of a stack of wire core half units illustrating the nestably stackable nature of the half units.

The spring portions, at their upper end 34, are open from above without any interference from the lacing wires or filler wires. The open upper end 34 together with the tapering V-shape of the spring portions enables a plurality of the wire core half units 10 to be stacked, with the spring portions of one unit being nested within the spring portions of the half unit therebelow. Such a stack of the wire core half units 10 is shown in FIG. 2.

Figure 3A:
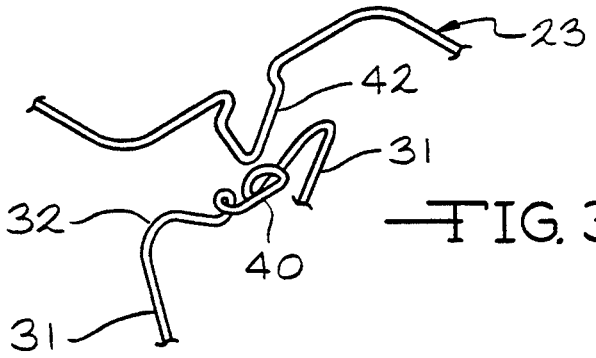
FIG. 3*a* is an enlarged perspective view of the connecting elements of the half units shown in the circle 3*a* of FIG. 3.
Figure 3:
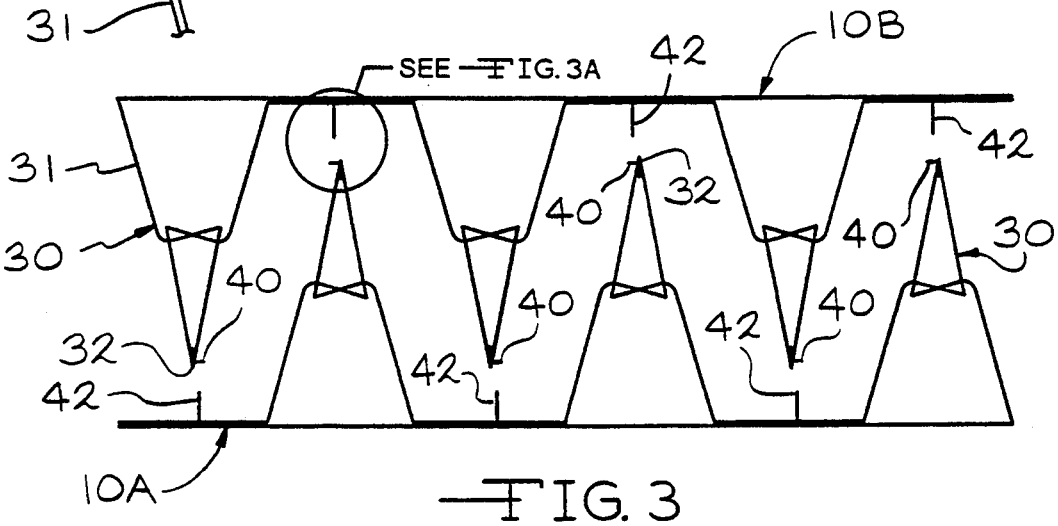
FIG. 3 is a single line schematic elevational view of a pair of half units, one inverted relative to the other, in alignment for attachment to one another.

A complete spring wire core is comprised of two of the half units 10. The lower half unit 10*a* shown in FIG. 3 is inverted relative to the upper half unit 10*b*. As the upper half unit 10*b* is placed on the lower half unit 10*a*, connecting elements, described in greater detail below, are brought together to connect the two half units together, forming the assembled spring wire core 36 shown in FIG. 4.

The wire core 36, by being constructed of a pair of half units 10, has a pair of spaced surface portions 28. Lower surface portion 28*a* is formed by the lower half unit 10*a* and is spaced from the upper surface portion 28*b* formed by the upper half unit 10*b*.

Figure 4A:
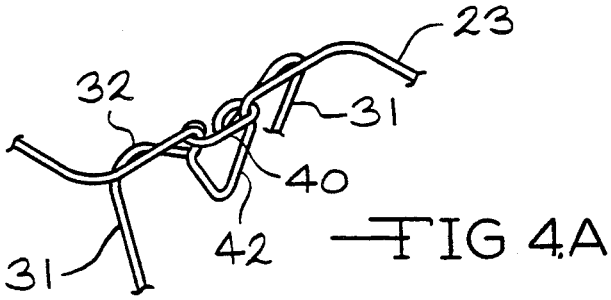
FIG. 4*a* is an enlarged perspective view of the connecting elements of the half units shown in circle 4*a* of FIG. 4.
Figure 4:
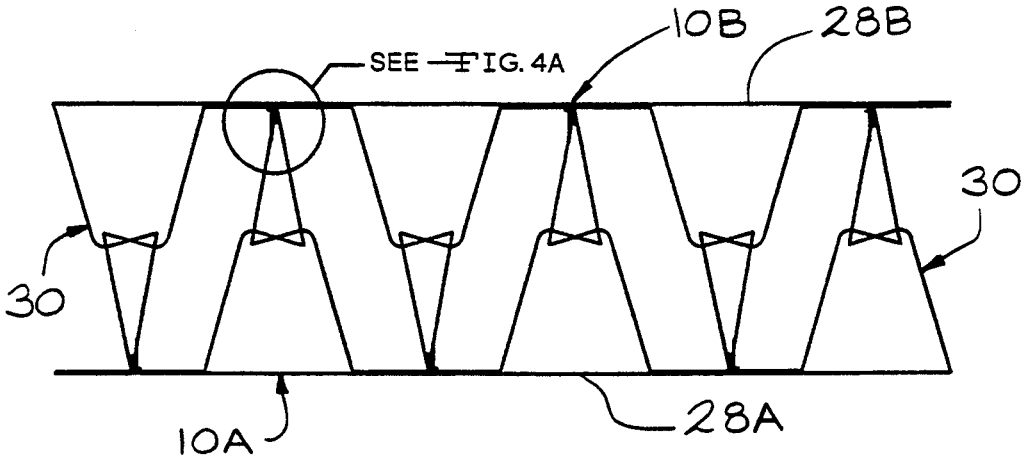
FIG. 4 is a single line schematic elevational view similar to FIG. 3 showing the two half units attached to one another.

The vertices 32 of the spring portions 30 are each formed with a female connecting element 40 which is generally loop shaped. The female connecting elements 40 are generally parallel to the surface portion of the half unit. The spring elements 18, in their top portions, include male connecting elements 42 which are generally spade shaped. The male connecting elements 42 are generally normal to the surface portion of the half unit. As two half units are brought together with one unit inverted relative to the other, the spade and loop connecting elements are brought together as shown in FIG. 3*a*. Both the spade 42 and loop 40 elements are resilient to enable the spade elements 42 to be inserted into loop elements 40 and to be locked in place as shown in FIG. 4*a*. The force necessary to lock the connecting elements may be applied by hand assembly on individual lock points or through a standard upholstery press that is commonly used at most assembly plants.

The spade and loop connecting elements are illustrative of only one male/female connecting scheme. Various alternatives can be employed equally as well. In addition, other connecting means, such as attaching clips, can be used if desired.

With reference to FIG. 2, it can be seen that the spade connecting elements 42 are deflected in the stack of half units. This is necessary due to the fact that the spade elements are closed at their upper ends. Since these elements can not be nested, they are deflected sideways to enable full stacking of the half units.

The spring wire core of the present invention is easily adaptable to customized firmness zones by strategic removal or addition of spring elements and surface filler wires. Firmness zones of this type can be used to provide, for example, extra lumbar support or allow less pressure around shoulder and hip areas.

Figure 5:
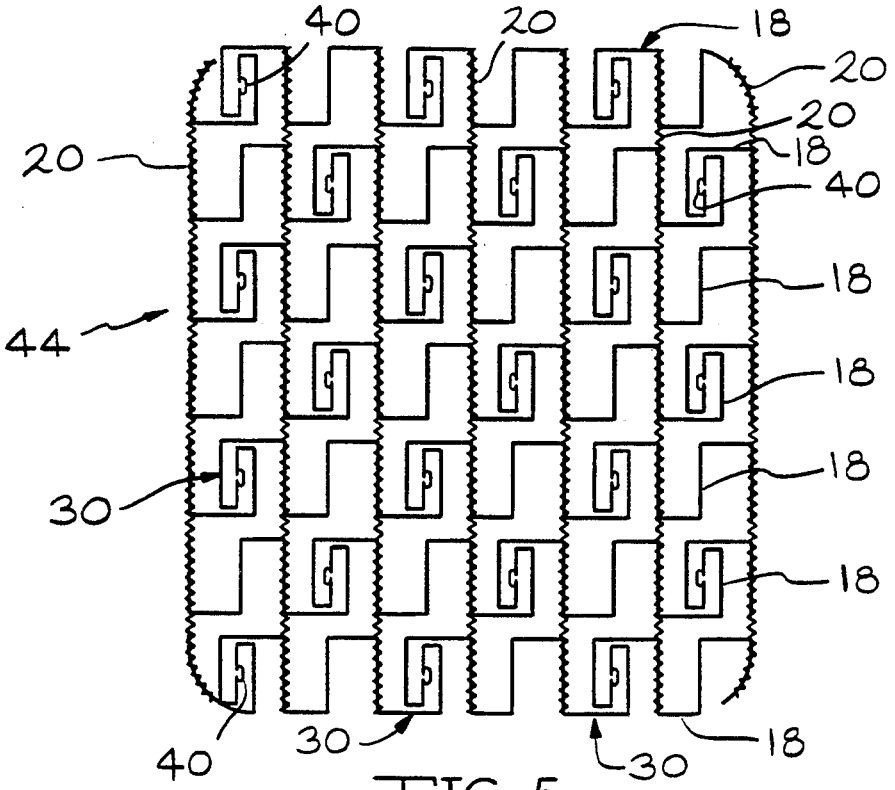
FIG. 5 is a single line schematic top view of an alternative embodiment of a half unit of the wire core of the present invention.

Numerous alternative embodiments of the present invention are possible. For example, FIG. 5 illustrates a half unit 44 in which the surface filler wires 24 have been replaced by additional spring elements 18. The number and spacing of the spring elements is dependent upon the desired firmness for the spring wire core.

Half unit 44 is also constructed without a border wire 12. A pair of helical lacing wires 20 are added to form the edges of the half unit, parallel to the internal lacing wires 20. No separate perimeter border wire is required. Cores of this type, without a border wire, are used in sleeper sofas, folding RV beds, etc. The lacing wires provide flexibility to the core that would not be present with the border wires.

Figure 6:
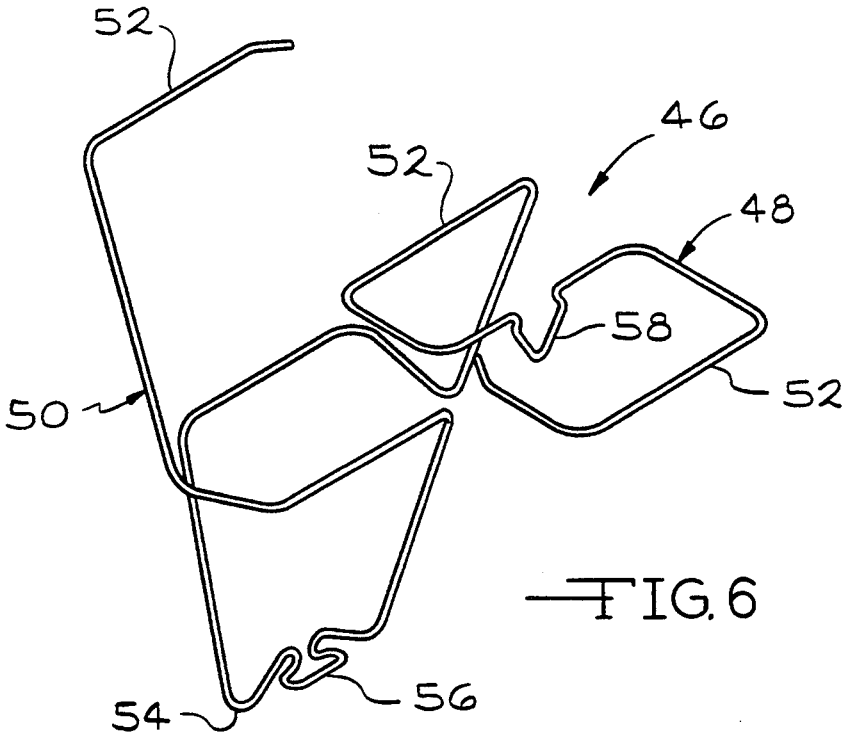
FIG. 6 is a perspective view of an alternative spring element used in the wire core half units.

FIG. 6 shows an alternative embodiment of the spring elements used in the core. Individual spring elements 46 can be used in place of the continuous spring elements 18 that extended from end-to-end or side-to-side of the core. Individual spring elements 46 have top portions 48 and a single spring portion 50 projecting therefrom. The top portion 48 is used to mount the individual spring elements 46 by the lacing wires 20 wrapped around mounting bars 52 in the top portion 48. At the vertex of the V-shaped spring portion 54, a female connecting element 56 is provided for reception of male connecting element 58 in the top portion 48 of a spring element. The continuous spring elements 18, which extend from end-to-end or side-to-side of the half units, have multiple spring portions. The individual spring elements 46 have only a single spring portion 50. It will be readily appreciated that the spring elements can be made with any number of spring portions as desired.

While in the preferred embodiment the spring wire cores 36 are made from two identical half units, it can be seen that the half units need not be identical. For example, one half unit may include a combination of spring elements and filler wires while the other half unit may be comprised solely of spring elements. The filler wires would then include connecting elements for mating with corresponding connecting elements in the spring elements of the opposite half unit. Where nonidentical half units are used, two stacks of half units would be present at assembly of the cores. One stack for one half unit and another stack for the other half unit.

It is not necessary that the vertex of the spring portions of one half unit contact the surface portion of the opposite half unit. The two half units could be connected to one another by connecting elements at the distal ends of the spring portions. In such a case, each half unit would have a height approximately equal to half the height of the assembled wire core. Furthermore, it is not necessary for all of the spring portions to have a connecting element. A theoretical minimum number of connecting elements is one. However, a practical minimum is one connecting element at each of the four corners and one in the center of the wire core.

The spring wire core of the present invention is formed by two half units which are preferably nestably stackable to enable a plurality of the half units to be shipped in a relatively compact and safe stack. The wire cores are assembled by inverting one half unit relative to the other half unit and connecting the two half units together. In the preferred embodiment, the half units include connecting elements to enable assembly of the wire cores without the use of separate fasteners. The wire core of the present invention thus meets the objective of the invention. The wire half units can be efficiently and safely shipped from a wire manufacture to an upholstery manufacturer without the need for compression of the springs.

It is to be understood that the invention is not limited to the exact construction illustrated and described above, but that various changes and modifications may be made without departing from the spirit and scope of the invention as defined in the following claims.

We claim:

1. A spring wire core comprising:

a first half unit including means forming a first surface portion and means forming a plurality of spring portions projecting from one side of said first surface portion;

a second half unit including means forming a second surface portion and means forming a plurality of spring portions projecting from one side of said second surface portion; and means for joining said first and second half units together with said second half unit being inverted relative to said first half unit and with said spring portions of one half unit projecting toward the surface portion of the other half unit thereby forming said wire core with spaced first and second surface portions.

2. The wire core of claim 1 wherein each of said first and second surface portions comprises:

a plurality of lacing wires; and a plurality of spring elements having top portions, said top portions and said lacing wires generally lying in a common plane to define said surface portions.

3. The wire core of claim 2 wherein the top portions of said spring elements include mounting bars with said lacing wires being wrapped around said mounting bars to couple said spring elements to said lacing wires.

4. The wire core of claim 2 wherein said spring elements are integrally formed with said top portion and said spring portions projecting therefrom, each of said spring elements including at least one of said spring portions.

5. The wire core of claim 2 wherein said surface portions each include a border wire at the perimeter of said surface portions defining opposite sides and ends of said surface portions.

6. The wire core of claim 5 wherein each of said spring elements have a plurality of said spring portions projecting therefrom.

7. The wire core of claim 5 wherein each of said spring elements have only one spring portion projecting therefrom.

8. The wire core of claim 2 wherein said surface portions further comprise at least one filler wire extending parallel to the top portions of said spring elements between a pair of said spring elements to provide support at said surface portion between said pair of spring elements.

9. The wire core of claim 1 wherein said spring portions are V-shaped comprising a pair of legs, each leg including a torsion bar and said pair of legs converging to a common lower bar parallel to said torsion bars.

10. The wire core of claim 1 wherein said means for joining said half units to one another includes male and female connecting elements formed in said half units.

11. The wire core of claim 1 wherein said means for joining said half units to one another includes receptor means generally parallel to said surface portion and projection means generally normal to said surface portion for snap fit engagement into said receptor means for connecting a pair of said half units to one another.

12. The wire core of claim 11 wherein said receptor means is located at distal ends of said spring portions and said projection means is located at said surface portions of said half units and spaced laterally from said spring portions, said half units being oriented with respect to one another so that the receptor means of one half unit at the distal ends of the spring portions is aligned with the projection means at the surface portion of the other half unit for snap fit engagement of said receptor means and said projection means to connect said half units to one another.

13. The wire core of claim 12 wherein said spring elements include said spring portions and top portions disposed within said surface portions, said projecting means being formed on said top portions of said spring elements between said spring portions for engagement with said receptor means of the other half unit forming said wire core.

14. The wire core claim 1 wherein said first and second half units are identical to one another.

15. The wire core of claim 1 wherein, within each half unit, the spring portions projecting from the surface portion of each half unit taper in a direction away from said surface portions and the spring portions are open at the surface portions whereby a plurality of said first and second half units can be nestably stacked with the spring portions of one half unit being inserted into the spring portions of the half unit therebelow.

16. A vertical stack of spring wire core half units, each half unit having means forming a surface portion, means forming spring portions projecting from one side of said surface portion and connector means for connecting two of said half units together with one of said half units inverted relative to the other of said two half units, said spring portions tapering away from said surface portions and being open at said surface portions whereby the spring portions of one half unit can be nested into the spring portions of the half unit therebelow in said stack of half units.

17. The vertical stack of wire core half units of claim 16 wherein said connector means includes first and second connector elements, said first connector elements of one half unit being engagable with said second connector elements on another of said half units when said another half unit is inverted relative to said one half unit and said half units are brought into engagement with one another with said first and second connector elements being aligned with one another.

18. The vertical stack of wire core half units of claim 17 wherein said first connector elements are located at distal ends of said spring portions and said second connector elements are located on said surface portions.

19. A spring wire core comprising:

a first half unit including a plurality of first spring elements having top portions generally lying in a first plane and spring portions extending away from said first plane in one direction, and first lacing wires in said first plane connected to said top portions of said first spring elements to join said first lacing wires and said first spring elements together, said first lacing wires and said top portions forming a first surface portion for said wire core;

a second half unit including a plurality of second spring elements having top portions generally lying in a second plane and spring portions extending away from said second plane in one direction, and second lacing wires in said second plane connected to said top portions of said second spring elements to join said second lacing wires and said second spring elements together, said second lacing wires and said top portions forming a second surface portion for said wire core; and means for joining said first and second half units together with said second half unit being inverted relative to said first half unit and with said spring portions of each half unit projecting toward the surface portion of the other half unit thereby forming said wire core with space first and second surface portions and said spring portions therebetween.

20. The spring wire core of claim 19 further comprising border wires at the perimeter of said first and second half units.

21. The spring wire core of claim 19 wherein, within each half unit, the spring portions projecting from the top portions of the spring elements taper in a direction away from said surface portion and the spring portions are open at the surface portions whereby a plurality of said first and second half units can be nestably stacked with the spring portions of one half unit being inserted into the spring portions of the half unit therebelow.

22. The spring wire core of claim 19 wherein said means for joining said half units to one another includes male and female connecting elements formed in said half units.

23. A spring wire core for use in furniture having spaced top and bottom surface portions, said spring wire core comprising:

a first half unit having means forming a surface portion and means forming a plurality of spring elements having spring portions extending in one direction from said surface portion, said spring elements having spring portions which taper away from said surface portion and which are open at said surface portion whereby a plurality of said half units can be nestably stacked with the spring portions of one half unit being inserted into the spring portions of the half unit therebelow;

a second half unit identical to said first half unit;

means for joining said first and second half units together with said second half unit being inverted relative to said first half unit with the spring portions of one half unit extending toward the surface portion of the other half unit thereby forming said wire core with spaced top and bottom surface portions.

* * * * *